United States Patent [19]

Querner

[11] 3,967,774

[45] July 6, 1976

[54] CARTON LID HAVING EASILY OPENABLE, NON-RESEALABLE TAB

[75] Inventor: William Edward Querner, Springboro, Ohio

[73] Assignee: The Procter & Gamble Company, Cincinnati, Ohio

[22] Filed: May 23, 1975

[21] Appl. No.: 580,378

[52] U.S. Cl. ..... 229/51 TC; 229/43

[51] Int. Cl.[2] ..... B65D 5/54

[58] Field of Search ..... 229/51 TC, 51 SC, 51 D, 229/51 TS, 43, 51 R; 206/807

[56] References Cited

UNITED STATES PATENTS

| | | | |
|---|---|---|---|
| 2,396,310 | 3/1946 | Yungblut | 229/51 TC X |
| 3,310,223 | 3/1967 | Buttery | 229/51 TC |
| 3,392,905 | 7/1968 | Caldwell | 229/40 |
| 3,523,636 | 8/1970 | Phillips, Jr. | 229/51 TC |
| 3,595,466 | 7/1971 | Rosenburg | 229/51 TC X |
| 3,893,614 | 7/1975 | Meyers | 229/51 TC |
| 3,899,126 | 8/1975 | Palmer | 229/51 TC |

FOREIGN PATENTS OR APPLICATIONS

| | | | |
|---|---|---|---|
| 505,446 | 8/1954 | Canada | 229/51 SC |

*Primary Examiner*—Davis T. Moorehead
*Attorney, Agent, or Firm*—E. Kelly Linman; Fredrick H. Braun; John V. Gorman

[57] ABSTRACT

In a carton employing a turned-under lip along at least a portion of its periphery, an easily openable, non-resealable tab is provided for securing the carton lid to the body of a carton. The tab provides an easy open feature, secures the lid to the body of the carton, provides visual assurance that the carton has not been pilfered and eliminates the cost, nuisance and disposal problems normally associated with prior art overwrap materials and tear-out zippers. The tab requires a very low opening force which is highly reproducible. In addition, the tab is unaffected by minor carton damage. The tab is formed as an integral portion of the carton lid, is easily produced on standard packaging equipment, and, in a particularly preferred embodiment, requires no additional packaging material other than that required to form the carton lid.

10 Claims, 7 Drawing Figures

CARTON LID HAVING EASILY OPENABLE, NON-RESEALABLE TAB

BACKGROUND OF THE INVENTION

It is well known in the prior art that raw or exposed edges of carton board and like materials are often sharp and may cause injury unless extreme care is observed in handling the exposed edges. The most common way of protecting the user against injury on the exposed edges of prior art carton lids has been to provide a carton lid employing a turned-under lip along those portions of its periphery with which the user may come in contact. Prior art shoe boxes typically employ such a construction.

A difficulty common to such prior art cartons, however, is that the lids are not positively secured to the body of the carton. Thus, the cartons may be easily opened and their contents pilfered without visible detection. In the case of two-piece cartons, the carton lids may even become separated and lost from the carton body. To overcome these difficulties, overwrap materials of plastic, ribbon, string and the like have typically been employed. Such materials are not only expensive, but in addition must be disposed of when the carton is finally opened by the consumer.

Other prior art techniques which have been employed to avoid the difficulties mentioned above have included the use of removable zippers and tear-out panels in the carton lid. Such techniques have not proven completely satisfactory, however, since their functionality is normally adversely affected by minor carton damage, the force required to open the carton is normally quite high and often highly inconsistent, and the tear-out or zipper portion must be disposed of once the carton has been opened. In addition, removal of the tear-out or zipper portion on a carton intended to be displayed or reused after opening typically destroys the graphics or decorations applied to the carton in the area of the zipper or tear-out panel. Finally, such prior art techniques typically necessitate the use of additional carton board or similar material beyond that normally required to form the carton lid in order to provide a securement feature.

OBJECTS OF THE INVENTION

Accordingly, it is an object of the present invention to provide a carton lid employing a turned under lip along those portions of its periphery to which the consumer is ultimately exposed upon opening of the carton, said carton lid being secured to the body of a carton by means of an easily openable, non-resealable tab which is at least partially formed from the tuned under portion of the lip.

It is another object of the present invention to provide a carton lid which may be either hinged or fully removable, depending upon whether one or two such tabs are opened.

It is another object of the present invention to provide a carton lid having an irreversible opening feature which visually assures the consumer that the carton has not been pilfered, and which eliminates the cost, nuisance, and disposal problems associated with overwrap materials, removable zippers and tear-out panels.

It is yet another object of the present invention to provide a carton lid with a sealing feature having a consistently low opening force, which feature can be provided, in a particularly preferred embodiment, without the utilization of any additional carton board or similar material beyond that normally required to form the carton lid, and which can be fabricated on standard packaging equipment.

SUMMARY OF THE INVENTION

In a most preferred embodiment of the present invention, a carton lid employing a turned under lip along those portions of its periphery which are ultimately exposed to the consumer is provided with an easily openable, non-resealable tab for securing the carton lid to the body of a carton. The tab is at least partially formed from the turned under portion of the lip and includes a medial tear strip portion defined by a pair of tear lines extending the full depth of the tab. The attached end of the medial tear strip portion has a width substanially equal to that of the line of jointure between the tab and the carton lid, as measured at the attached end of the tab, while the width of the medial tear strip portion is less than the width of the tab along at least a portion of its length. This permits securement of the tab to the carton body along those portions of the tab which are outside the medial tear strip portion thereof.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in connection with the accompanying drawings in which:

DETAILED DESCRIPTION OF THE INVENTION

It should be noted that although the following description and illustrations are specifically directed to structures wherein the carton lid is separate from the carton body, the present invention may be practiced with equal facility in structures wherein the lid is formed as an integral portion of the carton.

Figure 1:
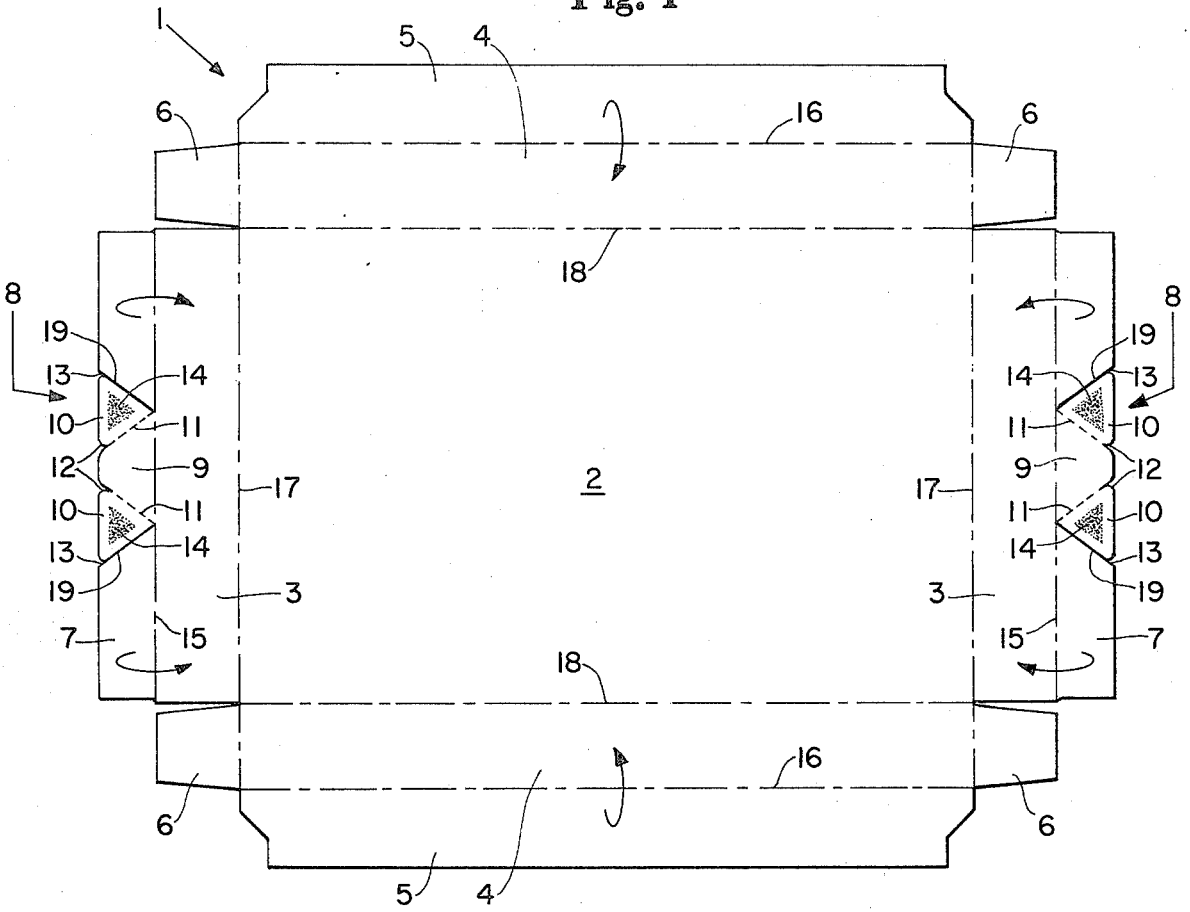
FIG. 1 is a plan view of a carton board blank from which a carton lid of the present invention is formed.
Figure 2:
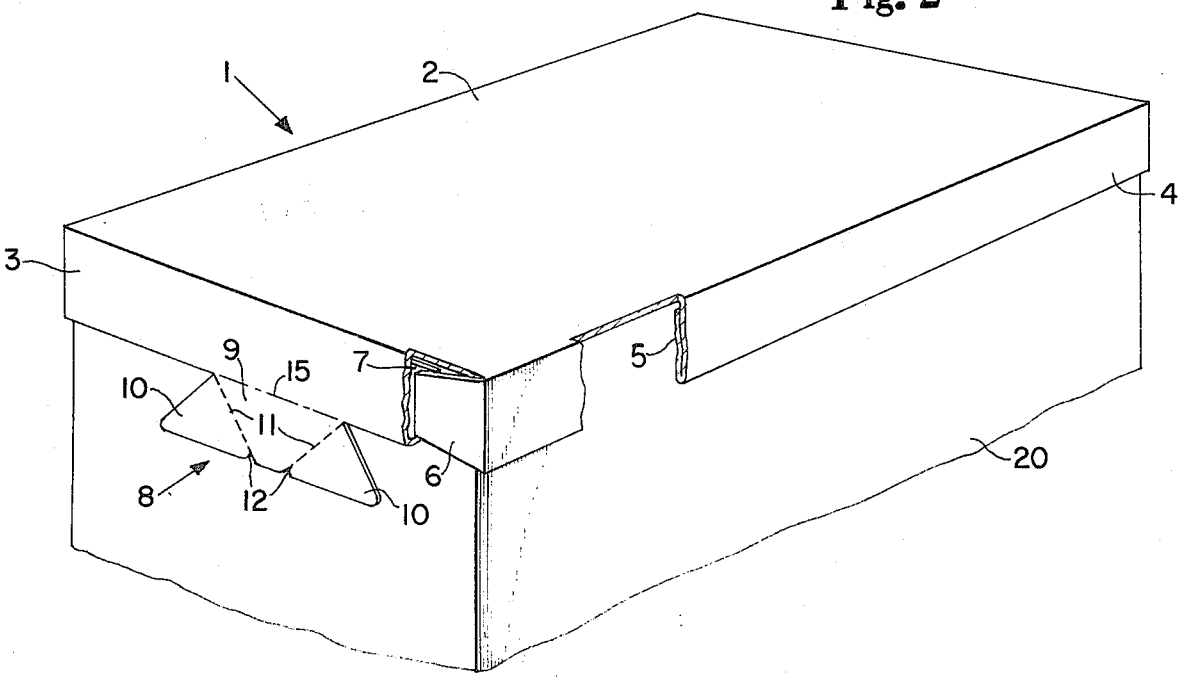
FIG. 2 is a perspective view showing the carton lid illustrated in FIG. 1 in its finally folded condition after securement of the lid to the body of a carton.

The carton lid blank 1 illustrated in FIG. 1 is comprised of a top panel 2 having end panels 3 and side panels 4 integrally attached thereto along score lines 17 and 18, respectively. To protect the user against injury due to the presence of sharp edges, end panels 7 which are joined to end panels 3 along score lines 15 and side panels 5 which are joined to side panels 4 along score lines 16 are turned under and secured as illustrated in FIG. 2. The ears 6 which are integrally attached to the side panels 4 are folded along score lines 17, inserted between end panels 3 and 7, and secured in place by means of a suitable adhesive, as shown in FIG. 2.

As is illustrated in FIG. 1, a tab 8 is formed in each end panel 7. The tab is preferably defined by means of a pair of cut lines 19 which connect the score lines 15 with the outermost portions of the end panels 7. A pair of tear lines 11, which are preferably comprised of perforations, intersect the cut lines 19 along the line of jointure between the tab 8 and the remainder of the carton lid, i.e., along score line 15. As will be appreciated by those skilled in the art, although perforations are utilized in a preferred embodiment of the present invention, other means well known in the art for providing weakening along tear lines 11 may be used with equal facility, i.e., cutting part way through the thickness of the carton board along the tear lines. The tear lines 11 which extend the full depth of the tab 8 serve to define a medial tear strip portion 9 of the tab. The medial tear strip portion 9 is bounded along its lateral edges by a pair of sealing surfaces 10.

The carton lid blank 1 illustrated in FIG. 1 is shown in its finally erected condition in FIG. 2. Those portions of the end panels 7 lying outside the tabs 8 are turned under along with the side panels 5 to provide a lip having a protected edge around the perimeter of the carton lid. The tabs 8, however, are not turned under, but rather are allowed to project along the end surfaces of the carton body 20. The carton lid 1 is secured to the carton body 20 by means of a suitable adhesive 14 applied to those portions of the tabs 8 which are outside the medial tear strip portions 9 thereof. Thus, the sealing surfaces 10 of the tabs serve to secure the carton lid 1 in position on the carton body 20 while the medial tear strip portions 9 remain unsecured to the carton body.

If desired, notches 12 may be provided at the free end of the tabs where the tear lines 11 intersect the free end of the tabs to facilitate identification of the tear strip portions 9 from the remainder of the tabs 8 and to improve the ease with which the tear strip portions can be grasped. If desired, notches 13 may also be provided where the cut lines 19 intersect the outermost portions of the end panels 7.

Figure 3:
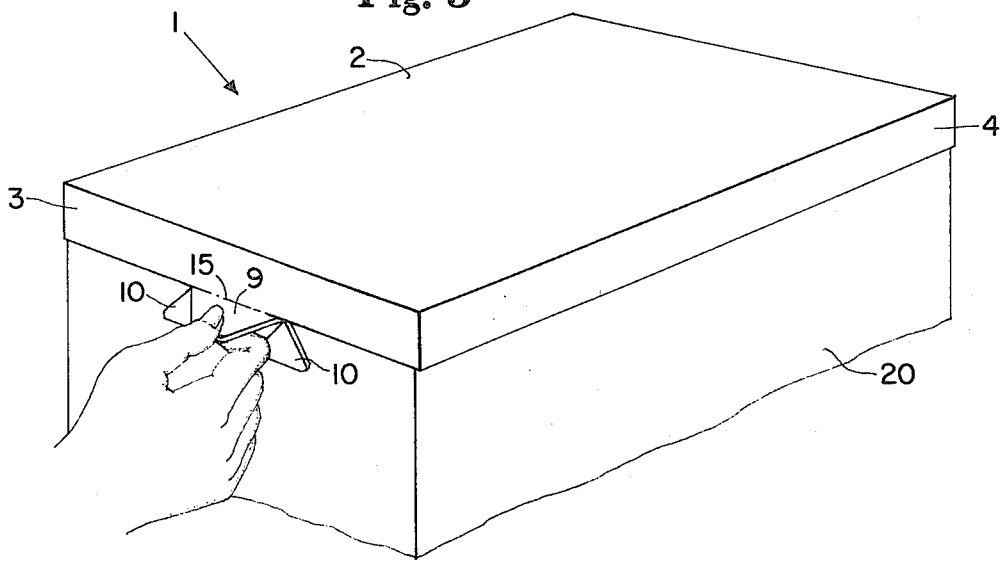
FIG. 3 is a perspective view of the carton and lid illustrated in FIG. 2, demonstrating the use of the medial tear strip portion of the tab to open one end of the carton.
Figure 4:
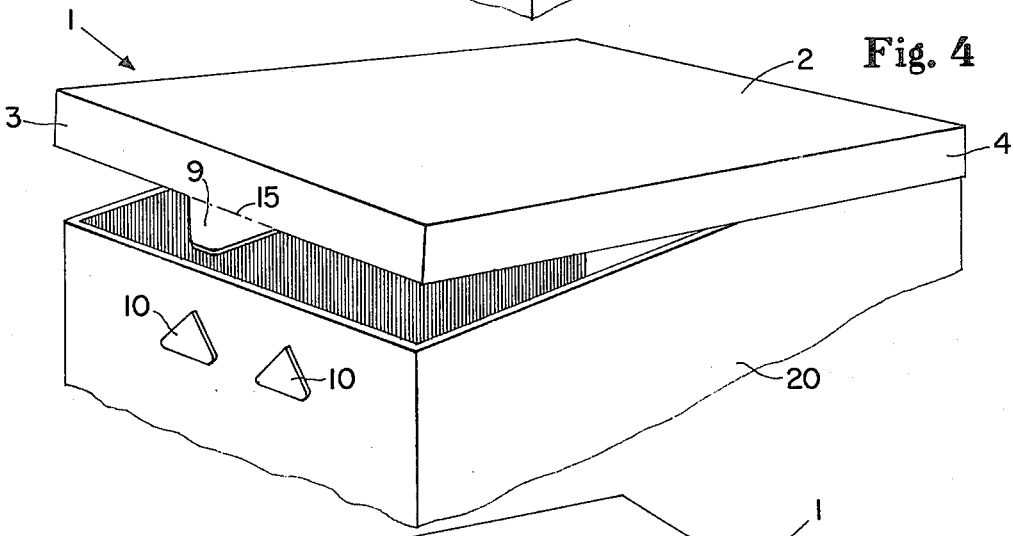
FIG. 4 is a perspective view of the carton and lid illustrated in FIGS. 2 and 3 after one end of the carton has been opened.

FIG. 3 illustrates the manner in which the tear strip 9 is utilized to facilitate opening of the carton. As is shown in FIG. 4, the medial tear strip portion 9 remains attached to the carton lid after the tab has been opened, while the outermost sealing portions 10 of the tab remain attached to the end walls of the carton body 20. The medial tear strip portion 9 may be left in the condition illustrated in FIG. 4, may be folded under along score line 15, or removed entirely from the opened carton. In the latter instance, the medial tear strip portion 9 is preferably connected to the carton lid along a line of jointure comprised of perforations to facilitate easy removal thereof.

Figure 5:
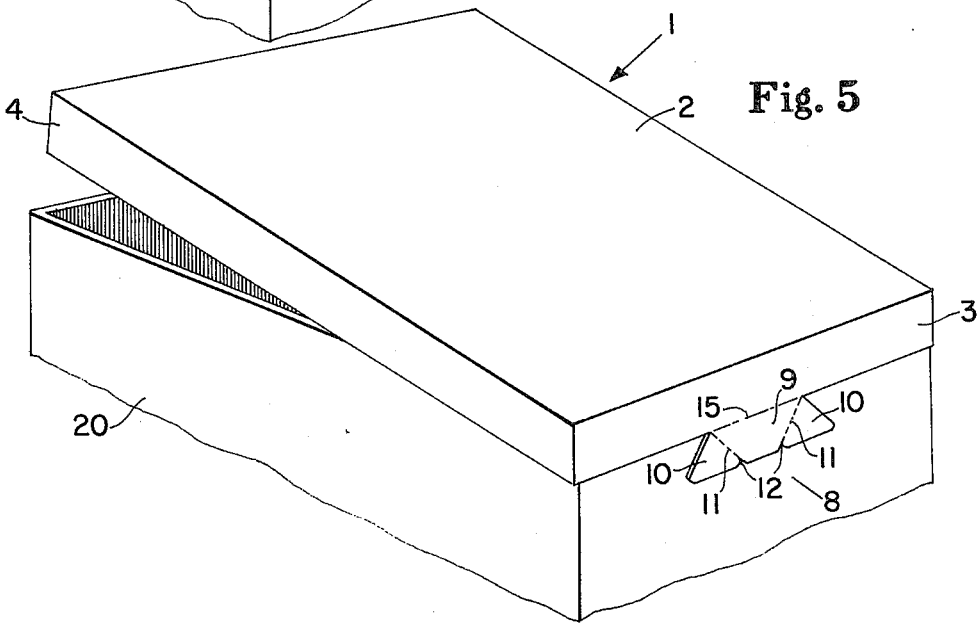
FIG. 5 is a perspective view of the back side of the carton illustrated in FIG. 4, showing the manner in which the unopened tab acts as a hinge for the carton lid.

FIG. 5 illustrates the back side of the carton and lid illustrated in FIGS. 2 – 4. As should be readily apparent, the tab 8 is being utilized as a hinge so that the lid 1 and the carton body 20 remain connected to one another. The pivoting action is provided along score line 15 which coincides with the line of jointure between the tab 8 and the remainder of the carton lid. If for any reason, it is desired to completely remove the carton lid 1 from the carton body 20 it is necessary only to open the second tab as illustrated in FIG. 3.

Figure 6:
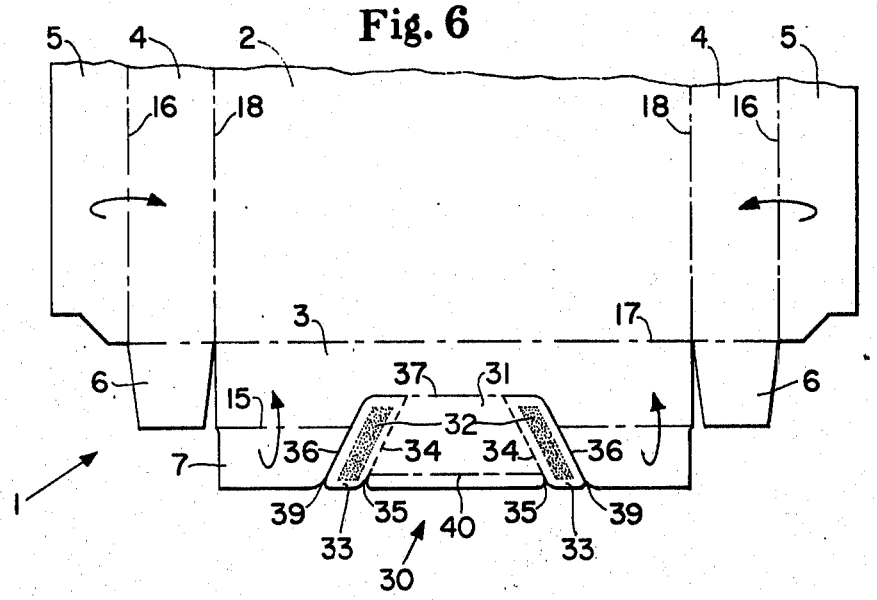
FIG. 6 is a partial plan view of a carton lid blank of the type illustrated in FIG. 1, disclosing an alternative tab configuration.

In FIG. 6 is illustrated yet another embodiment of a carton lid of the present invention. The carton lid blank 1 is basically the same as that illustrated in FIG. 1, but the tab 30 is defined by means of a pair of cut lines 36 which originate in end panel 3 and terminate at the outermost portion of end panel 7. The line of jointure 37 connecting the innermost end points of the cut lines 36 serves to secure the tab 30 to the remainder of the carton lid. The line of jointure 37 is preferably scored to prevent undesirable tearing of the carton lid in-use. The medial tear strip portion 31 is defined by means of a pair of tear lines 34 which preferably originate at the point of intersection between cut lines 36 and the line of jointure 37 between the tab 30 and the remainder of the carton lid. The tear lines 34, which are preferably comprised of perforations, extend the full depth of the tab 30 and terminate in notches 35 at the free end of the tab. If desired, notches 39 may also be provided at the point of intersection between cut lines 36 and the outermost portion of end panel 7.

In a particularly preferred embodiment of the present invention, a score line 40 connecting the innermost portions of notches 35 is provided across the medial tear strip portion 31 of the tab 30 to facilitate grasping the free end of the medial tear strip portion of the tab.

The carton lid illustrated in FIG. 6 is assembled in basically the same manner as the carton lid illustrated in FIG. 1. The lid is shown in an installed condition on a carton body 20 in FIG. 7. The lid is secured in position to the carton body 20 by means of a suitable adhesive 32 applied to the sealing portions 33 located outside the medial tear strip portion 31 of the tab.

Figure 7:
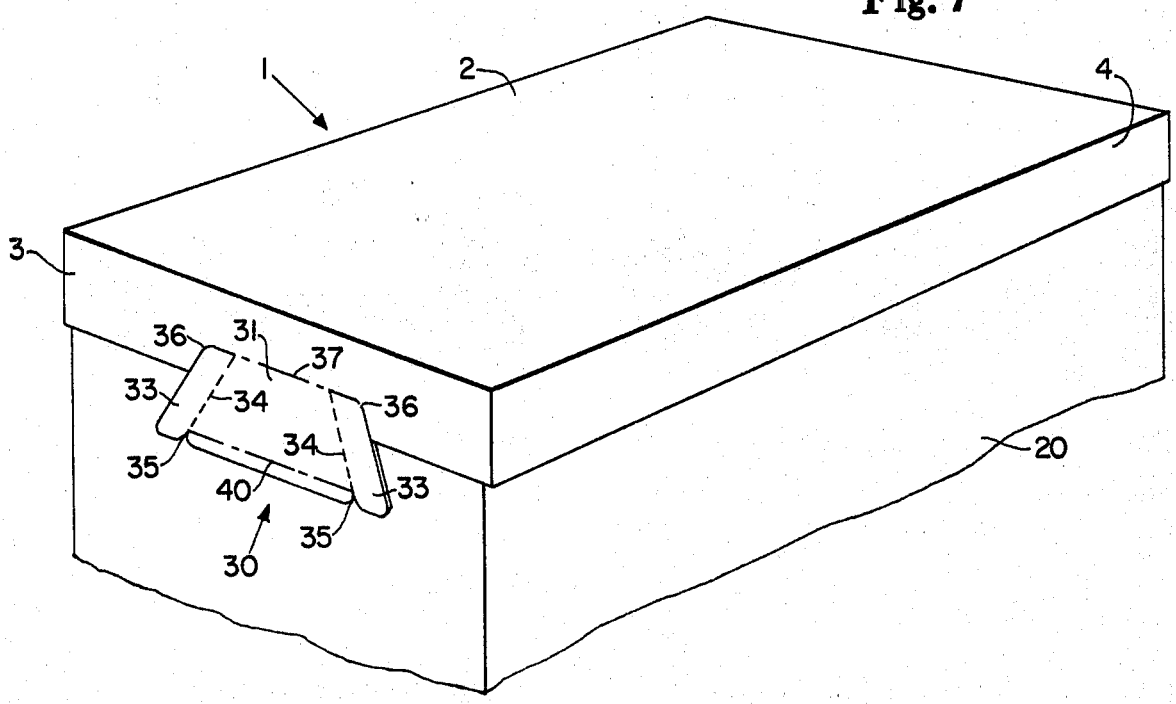
FIG. 7 is a partial perspective view of the carton lid illustrated in FIG. 6 in its finally folded condition after securement of the lid to the body of a carton.

In use, the carton lid illustrated in FIG. 7 is opened and functions in the same manner as the carton lid illustrated in FIGS. 1 – 5. It should be noted, however, that due to the fact that a portion of the tab 30 is formed from the end panel 3, less material may be employed in forming the turned under lip portion of the lid if desired. This offers a possible aesthetic advantage, particularly for decorated cartons intended for reuse or display, since the portion of the tab projecting below the lip of the carton may be reduced without adversely affecting the functionality of the tab.

A significant advantage of a carton lid of the present invention in comparison to prior art carton lids is the provision of an opening feature which requires a consistently low opening force. This is due to the fact that there is no adhesive securing the medial tear strip portion of the tab to the carton body and also due to the fact that upon rupture of the tear lines defining the medial tear strip portion of the tab there is nothing remaining to secure the carton lid to the carton body. Another highly significant advantage of a particularly preferred embodiment of the present invention is that the carton lid may be formed on conventional packaging equipment without the utilization of any additional carton board or like material beyond that which would normally be required to form a conventional carton lid having a turned under lip about its periphery.

In addition, a carton lid of the present invention provides a pilfer-proof feature previously lacking, particularly in two-piece carton structures, without the utilization of a third member, i.e., plastic overwrap, string, ribbon, etc. Since the medial tear strip portion of the tab preferably remains an integral portion of the carton lid after opening, the present invention eliminates disposal problems common to prior art systems.

For cartons employing extensive use of decorations, advertisements, or other graphics, the present invention provides improved aesthetic characteristics due not only to the relatively small size required by the tab, but also to the fact that, unlike prior art zipper and tear-out openings, the tabs utilized in carton lids of the present invention preferably remain an integral portion of the lid after opening.

Thus, it is apparent that there has been provided, in accordance with the present invention, an improved carton lid having a turned under lip along those portions of its periphery to which a user may ultimately be exposed, said improved carton lid incorporating an easily openable, non-resealable tab at least partially formed from the turned under portion of said lip. It should be noted, however, that while the invention has been described in conjunction with specific preferred embodiments thereof, it is evident that many alternatives, modifications and variations will be apparent to those skilled in the art in light of the foregoing description. Accordingly, it is intended to embrace all such alternatives, modifications, and variations that fall within the spirit and broad scope of the appended claims.

What is claimed is:

1. In a carton lid employing a turned under lip along the exposed portions of its periphery to protect the user from injury after initial opening thereof, the improvement comprising an easily openable, non-resealable, pilfer-proof tab for securing said carton lid to the body of the carton, said tab being at least partially formed from the turned under portion of said lip and including a medial tear strip portion defined by a pair of tear lines extending the full depth of said tab, the attached end of said medial tear strip portion having a width substantially equal to that of the line of jointure between said tab and said carton lid, as measured at the attached end of said tab, said tear strip portion having a width less than that of said tab along at least a portion of its length, thereby permitting securement of said tab to said carton body along those portions of said tab outside the medial tear strip portion thereof.

2. The carton lid of claim 1, wherein said medial tear strip portion has a width substantially equal to that of the line of jointure between said tab and said carton lid, as measured at the attached end of said tab, and a width less than that of said tab, as measured at the free end of said medial tear strip portion.

3. The carton lid of claim 1, wherein said tear lines are comprised of perforations.

4. The carton lid of claim 1, wherein a notch is provided at the intersection of each tear line with the free end of said tab to facilitate identification of the medial tear strip portion of said tab.

5. The carton lid of claim 4, wherein a score line interconnecting the innermost ends of said notches is provided across the medial tear strip portion of said tab to facilitate grasping the exposed edge of said medial tear strip portion.

6. The carton lid of claim 1, wherein a score line is provided along the line of jointure between said tab and said carton lid to permit utilization of said line of jointure as a hinge between said carton lid and the body of a carton.

7. The carton lid of claim 1, wherein perforations are provided along the line of jointure between said tab and said carton lid to permit removal of said tab from said carton lid after opening thereof along said tear lines.

8. The carton lid of claim 1, wherein said tab is formed exclusively from the turned under portion of the lip of said carton lid and the line of jointure between said tab and said carton lid coincides with the exposed edge of said lip.

9. The carton lid of claim 1, wherein a tab is provided at opposite ends thereof for securing both ends of said carton lid to a carton body.

10. The carton lid of claim 1, wherein at least one end thereof is integrally attached to the body of a carton.

* * * * *

UNITED STATES PATENT AND TRADEMARK OFFICE

CERTIFICATE OF CORRECTION

PATENT NO. : 3,967,774

DATED : July 6, 1976

INVENTOR(S) : WILLIAM EDWARD QUERNER

It is certified that error appears in the above-identified patent and that said Letters Patent are hereby corrected as shown below:

Column 1, line 53, "tuned" should read -- turned --.

Signed and Sealed this

Fourth Day of April 1978

[SEAL]

*Attest:*

RUTH C. MASON
*Attesting Officer*

LUTRELLE F. PARKER
*Acting Commissioner of Patents and Trademarks*